US007985701B2

(12) United States Patent
Nakashima

(10) Patent No.: US 7,985,701 B2
(45) Date of Patent: Jul. 26, 2011

(54) WATER-DISCOLORING WALL ADHERING MATERIAL AND WATER-DISCOLORING WALL ADHERING MATERIAL SET USING THE SAME

(75) Inventor: Akio Nakashima, Nagoya (JP)

(73) Assignee: The Pilot Ink Co., Ltd., Nagoya (JP)

( * ) Notice: Subject to any disclaimer, the term of this patent is extended or adjusted under 35 U.S.C. 154(b) by 289 days.

(21) Appl. No.: 11/776,732

(22) Filed: Jul. 12, 2007

(65) Prior Publication Data

US 2008/0015317 A1 Jan. 17, 2008

(30) Foreign Application Priority Data

Jul. 12, 2006 (JP) ..... 2006-191122

(51) Int. Cl.
*B32B 9/04* (2006.01)

(52) U.S. Cl. ..... 442/153; 428/195.1; 428/211.1; 428/317.9; 434/85; 442/164; 442/416

(58) Field of Classification Search ..... 428/195.1, 428/292.1, 341, 211.1, 304.4, 317.9; 442/76, 442/153, 164, 416; 434/85
See application file for complete search history.

(56) References Cited

U.S. PATENT DOCUMENTS 3,197,330 A * 7/1965 Bartell ..... 427/208
6,416,853 B1 * 7/2002 Nakashima et al. ..... 428/313.9
6,852,399 B2 * 2/2005 Takahashi et al. ..... 428/213
6,953,345 B1 * 10/2005 Nakashima et al. ..... 434/408
2002/0052161 A1 5/2002 Nakashima et al.
2002/0150737 A1 * 10/2002 Nakashima ..... 428/195
2004/0135097 A1 * 7/2004 Shibahashi et al. ..... 250/474.1
2004/0185234 A1 9/2004 Nakashima et al.

FOREIGN PATENT DOCUMENTS

EP 0 919 604 A2 6/1999
EP 1 254 985 A2 11/2002
JP 3099269 U 11/2003

OTHER PUBLICATIONS

Machine translation of detailed description of JP 3099269 U. Created on Feb. 26, 2010.*

* cited by examiner

*Primary Examiner* — Mark Ruthkosky
*Assistant Examiner* — Gerard T Higgins
(74) *Attorney, Agent, or Firm* — Sughrue Mion, PLLC

(57) ABSTRACT

A relatively lightweight wall adhering material includes a non-woven fabric or a water-resistant paper, having a coating weight of from 40 to 150 g/m$^2$ as a substrate and provided thereon a porous layer in an amount of from 5 to 50 g/m$^2$. The porous layer includes a binder resin and a low-refractive-index pigment dispersed in the binder resin and firmly fixed thereto. The water-discoloring wall adhering material has a gross weight of from 50 to 200 g/m$^2$. The water-discoloring wall adhering material has excellent convenience at the time of production and use, promptly forms clear image to perceive, and is difficult to fall down when adhered to a wall.

11 Claims, 2 Drawing Sheets

WATER-DISCOLORING WALL ADHERING MATERIAL AND WATER-DISCOLORING WALL ADHERING MATERIAL SET USING THE SAME

FIELD OF THE INVENTION

The present invention relates to a water-discoloring wall adhering material and a water-discoloring wall adhering material set using the same. More particularly, it relates to a water-discoloring wall adhering material which shows different aspects in a dried state and in a state impregnated with water through a tool for water adhesion, and a water-discoloring wall adhering material set using the same.

BACKGROUND ART

Conventionally, a water-discoloring sheet which comprises a sheet having provided thereon a porous layer containing a low-refractive-index pigment, and a means for fixing to a wall is disclosed.

The water-discoloring sheet becomes transparent upon liquid absorption in the porous layer, and color tone of an underlying layer can be perceived (for example, see Patent Document 1).

A broadcloth made from a polyester and cotton blend material (which is also known as "TC broad") is disclosed as a substrate of the water-discoloring sheet. However, such a substrate involved the disadvantages that when a sheet is cut at the time of the production of the sheet, snag is generated, resulting in deterioration of productivity, and when the sheet is cut when used, snag is generated, resulting in impairing appearance of commercial products.

Further, the water-discoloring sheet has a waterproof layer comprising a polyethylene or the like provided on the back of the substrate. As a result, the sheet itself relatively increases its weight, and even though the sheet is fixed to a wall, there is the possibility that the sheet falls down by its own weight.

[Patent Document 1] Japanese Utility Model Registration No. 3099269

SUMMARY OF THE INVENTION

The present invention provides a relatively lightweight water-discoloring wall adhering material obtained by providing a specific amount of a porous layer on a non-woven fabric or a water-resistant paper, having a specific coating weight as a substrate. Liquid absorption properties are appropriate, and clear image can be developed. Additionally, users can purchase the wall adhering material and cut the same into an optional size and shape to put into practical use. Thus, the present invention overcomes the disadvantages of the conventional water-discoloring sheets, and intends to further increase merchantability of wall adhering materials of this type.

The present invention provides a water-discoloring wall adhering material comprising a non-woven fabric or a water-resistant paper, having a coating weight of from 40 to 150 g/m$^2$ and provided on the surface thereof a porous layer in an amount of from 5 to 50 g/m$^2$, the porous layer comprising a binder resin and a low-refractive-index pigment dispersed in the binder resin and firmly fixed thereto, and the wall adhering material having a gross weight of from 50 to 200 g/m$^2$.

Further, the present invention is characterized in that a colored layer is provided between the non-woven fabric or water-resistant paper and the porous layer; the porous layer is formed heterogeneously, and a color tone of an underlying layer is partially perceived in a dry state; a lightness value at a part on which the porous layer is formed is in a range of from 9.5 to 7.0 in a dry state; the non-woven fabric comprises a cellulose fiber and a polyester fiber; a mixing ratio of the cellulose fiber and the polyester fiber is from 95:5 to 50:50; stockigt sizing degree measured from the side at which the porous layer is provided is from 5 to 3,600 seconds; tear strength is 100 g or more; wet tensile strength is 0.5 Kg/15 mm or more; a shape of the water-discoloring wall adhering material is a rectangle or a square, and a belt-like colored pattern layer is provided on the uppermost layer at the edge of at least one side; and the colored pattern layer is a layer formed by a process printing comprising at least yellow, cyan and magenta.

Furthermore, the present invention provides a water-discoloring wall adhering material set comprising the water-discoloring wall adhering material and a wall fixture; a water-discoloring wall adhering material set comprising the water-discoloring wall adhering material and a tool for water adhesion; and a water-discoloring wall adhering material set comprising the water-discoloring wall adhering material, a wall fixture and a tool for water adhesion.

The present invention provides a relatively lightweight wall adhering material comprising a non-woven fabric or a water-resistant paper, having a specific coating weight as a substrate and provided thereon a specific amount of a porous layer. Therefore, the present invention can provide a water-discoloring wall adhering material which has excellent convenience at the time of production and use, promptly forms clear image to perceive, is difficult to fall down when adhered to a wall, and has high commercial value, and a water-discoloring wall adhering material set using the same.

NUMERICAL REFERENCES AND SIGNS IN FIGS. ARE DESCRIBED

Figure 1:
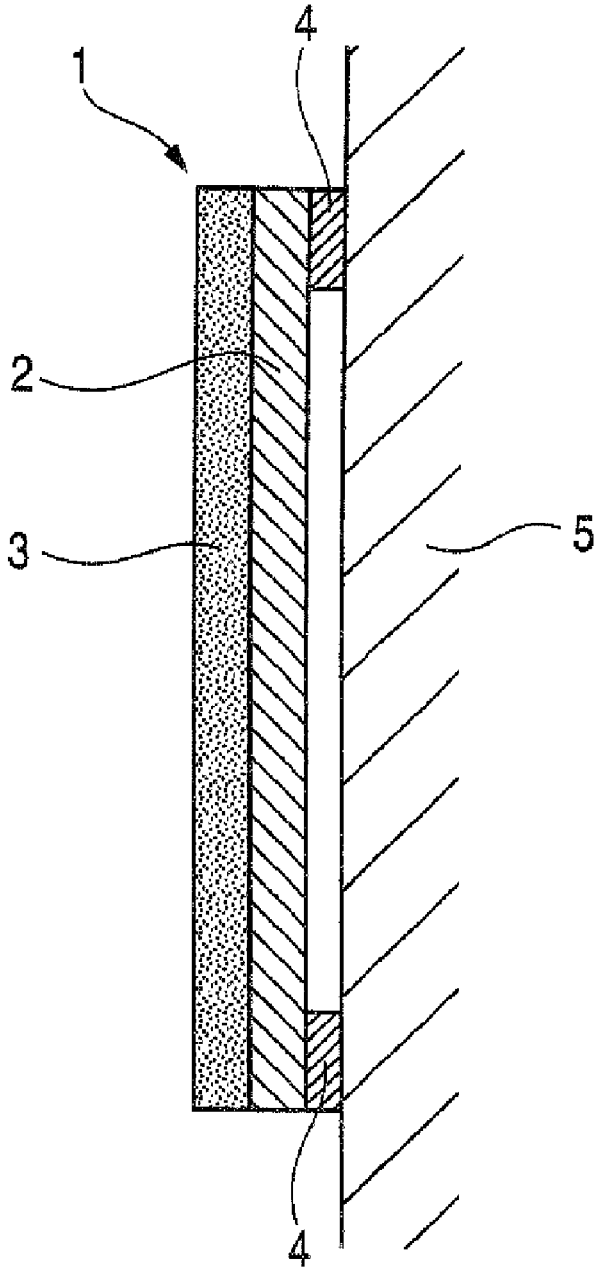
FIG. 1 is an explanatory view showing the state that a color-discoloring wall adhering material of one example of the invention is fixed to a wall.

1 Water-discoloring wall adhering material
2 Non-woven fabric
3 Porous layer
4 Wall fixture
5 Wall
6 Colored layer
7 Colored pattern layer

DETAILED DESCRIPTION OF THE INVENTION

The non-woven fabric or water-resistant paper as the substrate provided on a water-impermeable material uses a non-woven fabric or water-resistant paper, having a coating weight in a range of from 40 to 150 g/m$^2$, and preferably from 40 to 120 g/m$^2$.

Where the non-woven fabric or water-resistant paper has a coating weight of less than 40 g/m$^2$, strength is poor. Further, water absorption property is heterogeneous and insufficient, and water falls in drops, making it difficult to form clear image.

Where the coating weight exceeds 150 g/m$^2$, the water-discoloring wall adhering material prepared becomes heavy. As a result, even though the wall adhering material is fixed to a wall with a fixture, the wall adhering material is liable to drop down by its own weight, and additionally water retention property is too high, and molds and the like are liable to propagate, which is unsanitary.

The non-woven fabric preferably uses a non-woven fabric comprising a cellulose fiber and a polyester fiber. Examples of the water-resistant paper used include a water-resistant base paper produced by internally adding an appropriate amount of a water-resisting agent such as a modified rosin emulsion to a pulp, and a printing water-resistant paper produced by applying a water-resistant resin such as a synthetic rubber and an acrylic resin to a surface of the water-resistant base paper.

In the non-woven fabric comprising a cellulose fiber and a polyester fiber, it is preferable that the mixing ratio of the cellulose fiber and the polyester fiber is from 95:5 to 50:50. Where the mixing ratio of the polyester fiber is less than 5%, water resistance is poor, and concavity and convexity are formed by the repeated use, making it easy to impair merchantability. On the other hand, where the mixing ratio of the cellulose fiber is less than 50%, water absorption property is poor, and water falls in drops, making it difficult to form clear image.

The non-woven fabric comprising a cellulose fiber and a polyester fiber may be constituted of only the cellulose fiber and the polyester fiber, but the cellulose fiber and the polyester fiber may be present in the non-woven fabric in an amount of 70% or more, preferably 80% or more, and more preferably 90% or more. The non-woven fabric may contain a sizing agent such as a resin and an extender pigment, and a surface regulator such as a surfactant.

The porous layer formed on the non-woven fabric or water-resistant paper is a layer comprising a binder resin and a low-refractive-index pigment dispersed in the binder resin and firmly fixed thereto.

Examples of the low-refractive-index pigment used include silicic acid and its salt, barite powder, barium sulfate, barium carbonate, calcium carbonate, gypsum, clay, talc, alumina white and magnesium carbonate. Those have a refractive index in a range of from 1.4 to 1.8, and show good transparency upon liquid absorption.

Examples of the salt of silicic acid include aluminum silicate, potassium aluminum silicate, sodium aluminum silicate, calcium aluminum silicate, potassium silicate, calcium silicate, sodium calcium silicate, sodium silicate, magnesium silicate and potassium magnesium silicate.

The particle size of the low-refractive-index pigment is not particularly limited, but the pigment having a particle size in a range of from 0.03 to 10.0 μm is preferably used.

The low-refractive-index pigment can be used as mixtures of two kinds or more thereof.

Example of the low-refractive-index pigment preferably used includes silicic acid.

The silicic acid may be silicic acid produced by a dry process (hereinafter referred to as a "dry process silicic acid"), but silicic acid produced by a wet process (hereinafter referred to as a "wet process silicic acid") is preferably used.

This reason is described below.

Silicic acid is produced as an noncrystalline amorphous silicic acid, and depending on its production process, roughly classified into silicic acid produced by a dry process based on a vapor phase reaction such as pyrolysis of a silicon halide such as silicon tetrachloride, and silicic acid produced by a wet process based on a liquid phase reaction such as decomposition of an acid such as sodium silicate.

The dry process silicic acid and the wet process silicic acid differ in structure. Specifically, the dry process silicic acid has a structure constituted of densely linked silicic acid molecules, whereas the wet process silicic acid has structural parts each constituted of a long arrangement of molecular units formed by the condensation of silicic acid.

Therefore, the molecular structure of the wet process silicic acid is coarser than that of the dry process silicic acid. It is therefore presumed that when the wet process silicic acid is used in the porous layer, such a porous layer is excellent in irregular light reflection in a dry state, and as a result, has enhanced hiding properties in the ordinary state, as compared with a system using the dry process silicic acid.

The porous layer has the function to absorb water. Therefore, the wet process silicic acid has a large amount of hydroxyl groups as silanol groups on the particle surface and hence has a large degree of hydrophilicity as compared with the dry process silicic acid. For this reason, the wet process silicic acid is preferably used.

To regulate the hiding properties of the porous layer in the ordinary state and the transparency after liquid absorption, the wet process silicic acid can be used together with other general-purpose low-refractive-index pigments.

Examples of the binder resin used include urethane resins, nylon resins, vinyl acetate resins, acrylic ester resins, acrylic ester copolymer resins, acrylic polyol resins, vinyl chloride-vinyl acetate copolymer resins, maleic acid resins, polyester resins, styrene resins, styrene copolymer resins, polyethylene resins, polycarbonate resins, epoxy resins, styrene-butadiene copolymer resins, acrylonitrile-butadiene copolymer resins, methyl methacrylate-butadiene copolymer resins, butadiene resins, chloroprene resins, melamine resins, emulsions of the above-described resins, casein, starch, cellulose derivatives, polyvinyl alcohols, urea resins and phenolic resins.

The mixing ratio of the low-refractive-index pigment to those binder resins varies depending on the kind and properties of the low-refractive-index pigment. The binder resin is used in an amount of preferably from 0.5 to 2 parts by weight (solid basis), and more preferably from 0.8 to 1.5 parts by weight, per 1 part by weight of the low-refractive-index pigment. Where the amount (solid basis) of the binder resin is less than 0.5 part by weight per 1 part by weight of the low-refractive-index pigment, it is difficult to obtain a practically usable film strength of the porous layer. When the amount exceeds 2 parts by weight, the penetration of water into the porous layer deteriorates.

As compared with general coating films, the porous layer has small binder resin proportion to the coloring agent. Therefore, it is difficult to obtain sufficient film strength. For this reason, of the binder resins described above, a nylon resin or a urethane resin is preferably used to increase abrasion resistance.

Examples of the urethane resin include polyester urethane resins, polycarbonate urethane resins and polyether urethane resins. Those can be used as mixtures of two or more thereof. Further, the present invention can use a urethane emulsion resin prepared by emulsifying and dispersing the urethane resin in water, and a colloidal dispersion type (ionomer type) urethane resin prepared by dissolving and dispersing a urethane resin having ionicity (urethane ionomer) in water by means of self-emulsion based on its ionic groups without the aid of any emulsifying agent.

The urethane resin can use either of a water-based urethane resin and an oil-based urethane resin. However, a water-based urethane resin, particularly a urethane emulsion resin and a colloidal dispersion type urethane resin, is preferably used in the present invention.

The urethane resin can be used alone, but can be used in combination of one or more other binder resins according to the kind of the substrate and the performances required in the film. Where the urethane resin is used in combination with a binder resin other than the urethane resin, it is preferable that the urethane resin is contained in the binder resin of the porous layer in an amount of 30% by weight or more on a solid basis in order to obtain film strength sufficient for practical use.

When a crosslinkable resin is used in the binder resin, the film strength can further be improved by adding any desired crosslinking agent to crosslink the resin.

The binder resins vary in affinity for water. Combination of those makes it possible to regulate the time required for water to penetrate into the porous layer, the degree of penetration, and the rate of drying after penetration. Further, it is possible to control the above regulation by appropriately adding a dispersant.

The application amount of the porous layer is from 5 to 50 $g/m^2$, and preferably from 10 to 30 $g/m^2$.

Where the application amount is less than 5 $g/m^2$, it is difficult to obtain sufficient hiding properties in the ordinary state, and where it exceeds 50 $g/m^2$, it is difficult to obtain sufficient transparency after liquid absorption.

When the porous layer is formed heterogeneously to form a structure such that the color tone of the underlying layer is partially perceived in a dry state, texture like marble and marble pattern as in general wall papers are formed on the wall, thereby giving decoration properties.

The structure that the color tone of the underlying layer is partially perceived in a dry state is specifically as follows. When the lightness value at a part on which the porous layer is formed is in a range of from 9.5 to 7.0 in a dry state, moderately heterogeneous state can be perceived, and additionally, decoration properties in the dry state and the liquid absorption state can be satisfied without deterioration of image forming properties when water is applied.

The state that the porous layer is formed heterogeneously and the color tone of the underlying layer is partially perceived includes not only irregular patterns but regular patterns. Various regular patterns such as lattice patterns and wave patterns can be formed by using application methods of the porous layer and the non-woven fabric or water-resistant paper having patterns previously formed thereon.

It is possible to achieve color changes of the porous layer by adding thereto metalescent pigments such as mica coated with titanium dioxide, mica coated with iron oxide/titanium dioxide, mica coated with iron oxide, guanine, sericite, basic lead carbonate, acidic lead arsenate and bismuth oxychloride, or adding general dyes or pigments, fluorescent dyes or fluorescent pigments.

Further, a reversible thermochromic pigment showing reversible color change upon temperature change can be mixed to achieve color change by environmental temperature or temperature of water adhered.

A colored layer can be provided between the non-woven fabric or water-resistant paper and the porous layer to form a structure that the color tone of the underlying layer can be perceived after liquid absorption of the porous layer.

Further, a colored pattern layer can be provided on or near the porous layer, thereby further diversifying pattern change.

The colored pattern layer includes images of characters, marks, pictures and patterns.

When the water-discoloring wall adhering material has a shape of a rectangle or a square, a belt-like colored pattern layer is preferably provided on the uppermost layer at the edge of at least one side.

By providing the belt-like colored pattern layer as above, when the water-discoloring wall adhering material is fixed to the wall in a state that the colored pattern layer is positioned lower and water is applied thereto, water dropped down can be prevented from further dropping down by the colored pattern layer.

The belt-like colored pattern layer can be provided on the uppermost layer at the edges of two sides, three sides or four sides.

The colored layer and the colored pattern layer can appropriately be formed by the conventional techniques such as printing techniques including screen printing, offset printing, gravure printing, printing with a coater, tampon printing and transfer printing; and coating techniques including brushing, spray coating, electrostatic coating, electrodeposition, flow coating, roller coating and dip coating.

When the colored pattern layer is formed by process printing comprising at least yellow, cyan and magenta, a water-discoloring wall adhering material having further excellent decoration properties can be obtained.

The water-discoloring wall adhering material thus obtained has the gross weight of from 50 to 200 $g/m^2$.

When the gross weight is less than 50 $g/m^2$, both strength as the wall adhering material and hiding properties of the porous layer in the ordinary state cannot be satisfied. When the gross weight exceeds 200 $g/m^2$, the wall adhering material becomes heavy, and there is the possibility that the wall adhering material falls down by its own weight even though fixed to the wall.

The water-discoloring wall adhering material preferably has stockigt sizing degree measured from the side at which the porous layer provided of from 5 to 3,600 seconds. Where the stockigt sizing degree is less than 5 seconds, water is liable to adhere to the wall through the water-discoloring wall adhering material, and as a result, durability of the wall may be impaired.

The water-discoloring wall adhering material preferably has tear strength of 100 g or more and wet tensile strength of 0.5 Kg/15 mm or more.

When the tear strength is less than 100 g, the wall adhering material is liable to break when peeled, and when the wet tensile strength is less than 0.5 Kg/15 mm, the wall adhering material is liable to break by application of a tool for water adhesion when used, which is difficult to satisfy practicality.

The tear strength of the water-discoloring wall adhering material is preferably from 100 to 10,000 g, and the wet tensile strength thereof is preferably from 0.5 to 10 Kg/15 mm.

Even if the wall adhering material has the tear strength and wet tensile strength exceeding the respective upper limits, the wall adhering material can be used. However, the wall adhering material having the tear strength and wet tensile strength exceeding the respective upper limits becomes heavy, and there is the possibility that the wall adhering material falls down by its own weight even if fixed to the wall.

A water-discoloring wall adhering material set is obtained by combining the above-described water-discoloring wall adhering material and a wall fixture.

The wall fixture may be suction cups or pressure-sensitive adhesives, and may be magnets when the wall has magnetism.

Of the pressure-sensitive adhesives, where a liquid pressure-sensitive adhesive is used, the liquid pressure-sensitive adhesive can be applied partially or entirely to the back of the water-discoloring wall adhering material, and as a result, the wall adhering material can be adhered to the wall. Where a solid pressure-sensitive adhesive is used, the solid pressure-sensitive adhesive can be applied to corners of the back of the water-discoloring wall adhering material, and as a result, the wall adhering material can be adhered to the wall.

Examples of the solid pressure-sensitive adhesive include polybutylene rubbers, and solid pressure-sensitive adhesives comprising a mixture of polybutylene rubbers and inorganic minerals.

A water-discoloring wall adhering material set can further be obtained by combining the above-described water-discoloring wall adhering material and a tool for water adhesion.

Examples of the tool for water adhesion include writing materials or applicators, having a plastic porous body having continuous pores or a fiber-processed material as a pen tip material, and stamp materials.

The plastic porous body having continuous pores or the fiber-processed material may be any one so far as it absorbs an appropriate amount of water, and discharges the same, and examples thereof include general-purpose polyolefin, polyurethane and other various plastic porous bodies having continuous pores, penicillate materials obtained by bundling fibers, resin-processed or hot melt-processed fibers, felts, and non-woven fabrics. The shape and size can freely be set according to the purpose.

Writing materials or applicators having the above-described various materials as a pen tip member and fitting the same to the tip of a water storing container are effective.

When the above tool for water adhesion is set, optional writing images can be formed freely and conveniently, and practicality can be increased.

A water-discoloring wall adhering material set having convenience and practicality is obtained by combining the water-discoloring wall adhering material, the wall fixture and the tool for water adhesion.

EXAMPLES

The Examples are described below, but the invention is not limited to the Examples. In the Examples, "parts" means "parts by weight". In the Examples, the lightness value is a value obtained according to JIS Z 8721-1993 using TC-3600 calorimeter, a product of Tokyo Denshoku Co., Ltd.; the stockigt sizing degree is a value obtained according to JIS P 8122; the tear strength is a value obtained according to JIS P 8116; and the wet tensile strength is a value obtained according to JIS P 8113. Each value was measured under the environment of 23° C. and 50% relative humidity.

Example 1

See FIG. 1

A white screen printing ink was prepared by uniformly mixing and stirring 15 parts of a wet process silica fine powder (trade name, Nipsil E-200, manufactured by Nippon Silica Industrial Co., Ltd.), 30 parts of a urethane emulsion (trade name, Hydran HW-930, solid content 50%, manufactured by Dainippon Ink & Chemicals, Inc.), 50 parts of water, 0.5 part of a silicone antifoamer, 3 parts of a thickener for water-based inks, 1 part of ethylene glycol and 3 parts of an isocyanate crosslinking agent. Using the white screen printing ink, solid printing was conducted on the whole surface of a red non-woven fabric 2 having a coating weight of 50 g/m$^2$ made of 20% of a polyester fiber (3 denier, 10 mm) and 80% of a cellulose fiber through a 100 mesh screen stencil. The ink applied was dried and cured at 130° C. for 5 minutes to form a porous layer 3 (15 g/m$^2$). The resulting laminate thus obtained was cut into a rectangle of 50 cm×70 cm to obtain a water-discoloring wall adhering material 1 (65 g/m$^2$).

When the lightness value was measured in the state that the porous layer was dried, it was in a range of from 9.2 to 8.0. The stockigt sizing degree measured from the side at which the porous layer was provided was 6.5 seconds. The tear strength was 300 g, and the wet tensile strength was 4.0 kg/15 mm.

The water-discoloring wall adhering material shielded red color of the non-woven fabric and perceived a white state based on the porous layer in the ordinary state. When water was adhered to the porous layer, the porous layer became transparent to show color change of from white to red. The red color state was maintained during water adhesion, but when water was evaporated by drying, the color returned to the original white color.

A water-discoloring wall adhering material set was obtained by combining the water-discoloring wall adhering material obtained above and a pressure-sensitive adhesive comprising a mixture of a polybutylene rubber and an inorganic mineral, as a wall fixture 4.

The pressure-sensitive adhesive was adhered to each corner on the back of the water-discoloring wall adhering material to fix the same to a wall 5.

When water was adhered to the porous layer of the water-discoloring wall adhering material, the porous layer became transparent to show the change of from white to red. The red color state was maintained during water adhesion, but when water was evaporated by drying, the color returned to the original white color.

A water-discoloring wall adhering material set was obtained by combining the water-discoloring wall adhering material obtained above, a pressure-sensitive adhesive comprising a mixture of a polybutylene rubber and an inorganic mineral, as a wall fixture, and a writing material having a fiber-processed material having continuous pores as a pen tip member fitted to the tip of a water-storing container, as a tool for water adhesion.

The pressure-sensitive adhesive was adhered to each corner on the back of the water-discoloring wall adhering material to fix the same to a wall.

When water was applied to the porous layer of the water-discoloring wall adhering material using the writing material, clear red handwriting was perceived.

The handwriting was maintained during the state of water adhesion. When water was lost by drying, the red color returned to the original white color, and the handwriting was in an invisible state. This aspect could be conducted repeatedly.

Water which forms the handwriting did not drop down even in a vertical state of the wall adhering material. Water was moderately absorbed in the woven fabric, and additionally, water did not strike through into the back of the non-woven fabric.

The water-discoloring wall adhering material did not fall down by its own weight in the state of adhering to the wall, and did not fall down during use.

Even when written repeatedly, concavity and convexity were not generated on the surface and breakage did not occur. Thus, the wall adhering material was excellent in durability.

Example 2

Figure 2:
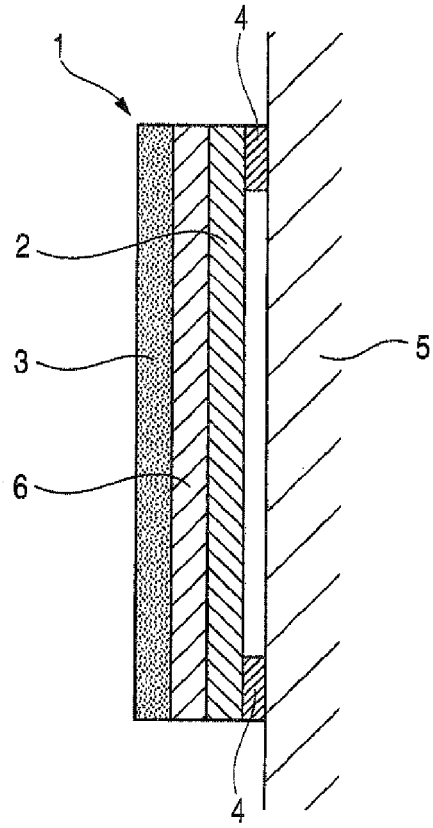
FIG. 2 is an explanatory view showing the state that a color-discoloring wall adhering material of other example of the invention is fixed to a wall.

See FIG. 2

A blue screen printing ink was prepared by uniformly mixing and stirring 5 parts of a blue pigment (trade name, Sundye Super Blue GLL, manufactured by Sanyo Colors Works, Ltd.), 50 parts of an acrylic ester emulsion (trade name, Movinyl 763, solid content 48%, manufactured by Hoechst Gosei K.K.), 3 parts of a thickener for water-based inks, 0.5 part of a leveling agent, 0.3 part of an antifoamer and 5 parts of an epoxy crosslinking agent. Using the blue screen printing ink, solid printing was conducted on the whole surface of a white non-woven fabric 2 having a coating weight of 90 g/m$^2$ made of 20% of a polyester fiber (1 denier, 10 mm), 70% of a cellulose fiber and 10% of an acrylic resin through a 150 mesh screen stencil. The ink applied was dried and cured at 100° C. for 3 minutes to form a blue colored layer 6 (10 g/m$^2$).

A white screen printing ink was prepared by uniformly mixing and stirring 15 parts of a wet process silica fine powder (trade name, Nipsil E-200, manufactured by Nippon Silica Industrial Co., Ltd.), 30 parts of a urethane emulsion (trade name, Hydran HW-930, solid content 50%, manufactured by Dainippon Ink & Chemicals, Inc.), 50 parts of water, 0.5 part of a silicone antifoamer, 3 parts of a thickener for water-based inks, 1 part of ethylene glycol and 3 parts of an isocyanate crosslinking agent. Using the white screen printing ink, solid printing was conducted on the whole surface of the colored layer formed above through a 80 mesh screen stencil. The ink applied was dried and cured at 130° C. for 5 minutes to form a porous layer 3 (20 g/m$^2$). The resulting laminate thus obtained was cut into a rectangle of 60 cm×90 cm to obtain a water-discoloring wall adhering material 1 (120 g/m$^2$).

When the lightness value was measured in the state that the porous layer was dried, it was in a range of from 8.7 to 7.5. The stockigt sizing degree measured from the side at which the porous layer was provided was 500 seconds. The tear strength was 500 g, and the wet tensile strength was 7.0 kg/15 mm.

The water-discoloring wall adhering material shielded blue color of the colored layer and perceived a white color state based on the porous layer in the ordinary state. When water was adhered to the porous layer, the porous layer became transparent to show color change of from white to blue. The blue color state was maintained during water adhesion, but when water was evaporated by drying, the color returned to the original white color.

A water-discoloring wall adhering material set was obtained by combining the water-discoloring wall adhering material obtained above and a pressure-sensitive adhesive comprising a mixture of a polybutylene rubber and an inorganic mineral, as a wall fixture 4.

The pressure-sensitive adhesive was adhered to each corner on the back of the water-discoloring wall adhering material to fix the same to a wall 5.

When water was adhered to the porous layer of the water-discoloring wall adhering material, the porous layer became transparent to show the color change of from white to blue. The blue color state was maintained during water adhesion, but when water was evaporated by drying, the color returned to the original white color.

A water-discoloring wall adhering material set was obtained by combining the water-discoloring wall adhering material obtained above, a pressure-sensitive adhesive comprising a mixture of a polybutylene rubber and an inorganic mineral, as a wall fixture, and a writing material having a fiber-processed material having continuous pores as a pen tip member fitted to the tip of a water-storing container, as a tool for water adhesion.

The pressure-sensitive adhesive was adhered to each corner on the back of the water-discoloring wall adhering material to fix the same to a wall.

When water was applied to the porous layer of the water-discoloring wall adhering material using the writing material, clear blue handwriting was perceived.

The handwriting was maintained during the state of water adhesion. When water was lost by drying, the red color returned to the original white color, and the handwriting was in an invisible state. This aspect could be conducted repeatedly.

Water which forms the handwriting did not drop down even in a vertical state of the wall adhering material. Water was moderately absorbed in the woven fabric, and additionally, water did not strike through into the back of the non-woven fabric.

The water-discoloring wall adhering material did not fall down by its own weight in the state of adhering to the wall, and did not fall down during use.

Even when written repeatedly, concavity and convexity were not generated on the surface and breakage did not occur. Thus, the wall adhering material was excellent in durability.

Example 3

Figure 3:
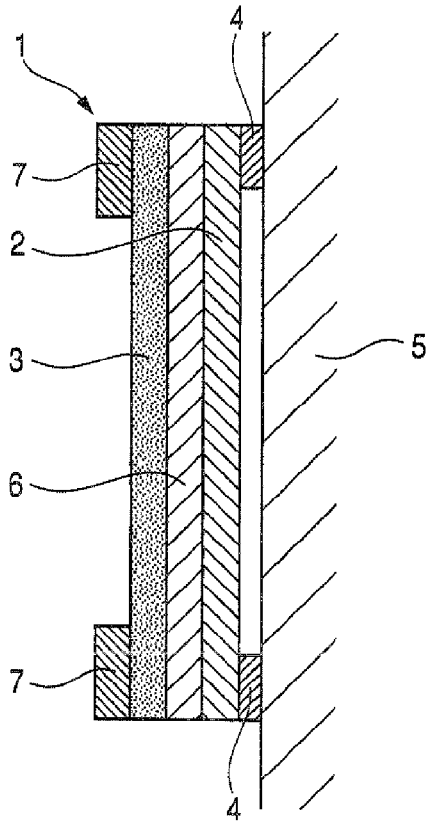
FIG. 3 is an explanatory view showing the state that a color-discoloring wall adhering material of other example of the invention is fixed to a wall.

See FIG. 3

A green screen printing ink was prepared by uniformly mixing and stirring 7 parts of a green pigment (trade name, Sundye Super Green GLL, manufactured by Sanyo Colors Works, Ltd.), 50 parts of an acrylic ester emulsion (trade name, Movinyl 763, solid content 48%, manufactured by Hoechst Gosei K.K.), 3 parts of a thickener for water-based inks, 0.5 part of a leveling agent, 0.3 part of an antifoamer and 5 parts of an epoxy crosslinking agent. Using the green screen printing ink, solid printing was conducted on the whole surface of a white non-woven fabric 2 having a coating weight of 70 g/m$^2$ made of 50% of a polyester fiber (3 denier, 10 mm) and 50% of a cellulose fiber through a 150 mesh screen stencil. The ink applied was dried and cured at 100° C. for 3 xminutes to form a green colored layer 6 (10 g/m$^2$).

A white screen printing ink was prepared by uniformly mixing and stirring 15 parts of a wet process silica fine powder (trade name, Nipsil E-200, manufactured by Nippon Silica Industrial Co., Ltd.), 30 parts of a urethane emulsion (trade name, Hydran HW-930, solid content 50%, manufactured by Dainippon Ink & Chemicals, Inc.), 50 parts of water, 0.5 part of a silicone antifoamer, 3 parts of a thickener for water-based inks, 1 part of ethylene glycol and 3 parts of an isocyanate crosslinking agent. Using the white screen printing ink, solid printing was conducted on the whole surface of the colored layer formed above through a 80 mesh screen stencil. The ink applied was dried and cured at 130° C. for 5 minutes to form a porous layer 3 (15 g/m$^2$). The resulting laminate thus obtained was cut into a rectangle of 65 cm×100 cm. Character of bear was printed in a belt-form on the upper part and the lower part of the porous layer with an oil-based UV-curing offset printing ink to provide a colored pattern layer 7. Thus, a water-discoloring wall adhering material 1 (97 g/m$^2$) was obtained.

When the lightness value was measured in the state that the porous layer was dried, it was in a range of from 8.6 to 7.4. The stockigt sizing degree measured from the side at which the porous layer was provided was 3,000 seconds. The tear strength was 1,000 g, and the wet tensile strength was 10.0 kg/15 mm.

The water-discoloring wall adhering material shielded green color of the colored layer and perceived white color based on the porous layer and the colored pattern layer in the ordinary state. When water was adhered to the porous layer, the porous layer became transparent to show color change of from white to green. The green color state was maintained during water adhesion, but when water was evaporated by drying, the color returned to the original white color.

A water-discoloring wall adhering material set was obtained by combining the water-discoloring wall adhering material obtained above and a pressure-sensitive adhesive comprising a mixture of a polybutylene rubber and an inorganic mineral, as a wall fixture 4.

The pressure-sensitive adhesive was adhered to each corner on the back of the water-discoloring wall adhering material to fix the same to a wall 5.

When water was adhered to the porous layer of the water-discoloring wall adhering material, the porous layer became transparent to show the color change of from white to green. The green color state was maintained during water adhesion, but when water was evaporated by drying, the color returned to the original white color.

A water-discoloring wall adhering material set was obtained by combining the water-discoloring wall adhering material obtained above, a pressure-sensitive adhesive comprising a mixture of a polybutylene rubber and an inorganic mineral, as a wall fixture, and a writing material having a fiber-processed material having continuous pores as a pen tip member fitted to the tip of a water-storing container, as a tool for water adhesion.

The pressure-sensitive adhesive was adhered to each corner on the back of the water-discoloring wall adhering material to fix the same to a wall.

When water was applied to the porous layer of the water-discoloring wall adhering material using the writing material, clear green handwriting was perceived.

The handwriting was maintained during the state of water adhesion. When water was lost by drying, the green color returned to the original white color, and the handwriting was in an invisible state. This aspect could be conducted repeatedly.

Water which forms the handwriting did not drop down even in a vertical state of the wall adhering material. Water was moderately absorbed in the woven fabric, and additionally, water did not strike through into the back of the non-woven fabric.

The water-discoloring wall adhering material did not fall down by its own weight in the state of adhering to the wall, and did not fall down during use.

Even when written repeatedly, concavity and convexity were not generated on the surface and breakage did not occur. Thus, the wall adhering material was excellent in durability.

Example 4

A blue screen printing ink was prepared by uniformly mixing and stirring 5 parts of a blue pigment (trade name, Sundye Super Blue GLL, manufactured by Sanyo Colors Works, Ltd.), 50 parts of an acrylic ester emulsion (trade name, Movinyl 763, solid content 48%, manufactured by Hoechst Gosei K.K.), 3 parts of a leveling agent, 0.3 part of an antifoamer and 5 parts of an epoxy crosslinking agent. Using the blue screen printing ink, solid printing was conducted on the whole surface of a white non-woven fabric having a coating weight of 100 g/m$^2$ made of 30% of a polyester fiber (1 denier, 5 mm), 67% of a cellulose fiber and 3% of a sizing agent (acrylketene dimer) through a 150 mesh screen stencil. The ink applied was dried and cured at 100° C. for 3 minutes to form a blue colored layer (10 g/m$^2$).

A white screen printing ink was prepared by uniformly mixing and stirring 15 parts of a wet process silica fine powder (trade name, Nipsil E-200, manufactured by Nippon Silica Industrial Co., Ltd.), 30 parts of a urethane emulsion (trade name, Hydran HW-930, solid content 50%, manufactured by Dainippon Ink & Chemicals, Inc.), 50 parts of water, 0.5 part of a silicone antifoamer, 3 parts of a thickener for water-based inks, 1 part of ethylene glycol and 3 parts of an isocyanate crosslinking agent. Using the white screen printing ink, solid printing was conducted on the whole surface of the colored layer formed above through a 80 mesh screen stencil. The ink applied was dried and cured at 130° C. for 5 minutes to form a porous layer (20 g/m$^2$). The resulting laminate thus obtained was cut into a rectangle of 60 cm×90 cm. Character of locomotive was printed in a belt-form on the upper part and the lower part of the porous layer with an oil-based UV-curing offset printing ink by a four-color separation process printing to provide a colored pattern layer. Thus, a water-discoloring wall adhering material (130 g/m$^2$) was obtained.

When the lightness value was measured in the state that the porous layer was dried, it was in a range of from 9.0 to 8.0. The stockigt sizing degree measured from the side at which the porous layer was provided was 20 seconds. The tear strength was 400 g, and the wet tensile strength was 5.0 kg/15 mm.

The water-discoloring wall adhering material shielded blue color of the colored layer and perceived a white color state based on the porous layer in the ordinary state. When water was adhered to the porous layer, the porous layer became transparent to show color change of from white to blue. The blue color state was maintained during water adhesion, but when water was evaporated by drying, the color returned to the original white color.

A water-discoloring wall adhering material set was obtained by combining the water-discoloring wall adhering material obtained above and a pressure-sensitive adhesive comprising a mixture of a polybutylene rubber and an inorganic mineral, as a wall fixture.

The pressure-sensitive adhesive was adhered to each corner on the back of the water-discoloring wall adhering material to fix the same to a wall.

When water was adhered to the porous layer of the water-discoloring wall adhering material, the porous layer became transparent to show the color change of from white to blue. The blue color state was maintained during water adhesion, but when water was evaporated by drying, the color returned to the original white color.

A water-discoloring wall adhering material set was obtained by combining the water-discoloring wall adhering material obtained above, a pressure-sensitive adhesive comprising a mixture of a polybutylene rubber and an inorganic mineral, as a wall fixture, and a writing material having a fiber-processed material having continuous pores as a pen tip member fitted to the tip of a water-storing container, as a tool for water adhesion.

The pressure-sensitive adhesive was adhered to each corner on the back of the water-discoloring wall adhering material to fix the same to a wall.

When water was applied to the porous layer of the water-discoloring wall adhering material using the writing material, clear blue handwriting was perceived.

The handwriting was maintained during the state of water adhesion. When water was lost by drying, the blue color returned to the original white color, and the handwriting was in an invisible state. This aspect could be conducted repeatedly.

Water which forms the handwriting did not drop down even in a vertical state of the wall adhering material. Water was moderately absorbed in the woven fabric, and additionally, water did not strike through into the back of the non-woven fabric.

The water-discoloring wall adhering material did not fall down by its own weight in the state of adhering to the wall, and did not fall down during use.

Even when written repeatedly, concavity and convexity were not generated on the surface and breakage did not occur. Thus, the wall adhering material was excellent in durability.

Example 5

A pink screen printing ink was prepared by uniformly mixing and stirring 5 parts of a pink pigment (trade name, Sundye Super Pink FBL, manufactured by Sanyo Colors Works, Ltd.), 50 parts of an acrylic ester emulsion (trade name, Movinyl 763, solid content 48%, manufactured by Hoechst Gosei K.K.), 3 parts of a thickener for water-based inks, 0.5 part of a leveling agent, 0.3 part of an antifoamer and 5 parts of an epoxy crosslinking agent. Using the pink screen printing ink, solid printing was conducted on the whole surface of a water-resistant paper having a coating weight of 100 $g/m^2$ made of a pulp and a modified rosin emulsion layer internally added thereto through a 150 mesh screen stencil. The ink applied was dried and cured at 70° C. for 3 minutes to form a pink colored layer (10 $g/m^2$).

A white screen printing ink was prepared by uniformly mixing and stirring 15 parts of a wet process silica fine powder (trade name, Nipsil E-200, manufactured by Nippon Silica Industrial Co., Ltd.), 30 parts of a urethane emulsion (trade name, Hydran HW-930, solid content 50%, manufactured by Dainippon Ink & Chemicals, Inc.), 50 parts of water, 0.5 part of a silicone antifoamer, 3 parts of a thickener for water-based inks, 1 part of ethylene glycol and 3 parts of an isocyanate crosslinking agent. Using the white screen printing ink, solid printing was conducted on the whole surface of the colored layer formed above through a 80 mesh screen stencil. The ink applied was dried and cured at 70° C. for 5 minutes to form a porous layer (15 $g/m^2$). The resulting laminate thus obtained was cut into a rectangle of 65 cm×100 cm. Flower patter was printed in a belt-form on the upper part and the lower part of the porous layer with an oil-based UV-curing offset printing ink made of four colors of yellow, cyan, magenta and black by a process printing to provide a colored pattern layer. Thus, a water-discoloring wall adhering material (127 $g/m^2$) was obtained.

When the lightness value was measured in the state that the porous layer was dried, it was in a range of from 9.5 to 8.5.

The water-discoloring wall adhering material shielded pink color of the colored layer and perceived a white color based on the porous layer and a colored pattern layer in the ordinary state. When water was adhered to the porous layer, the porous layer became transparent to show color change of from white to pink. The pink color state was maintained during water adhesion, but when water was evaporated by drying, the color returned to the original white color.

A water-discoloring wall adhering material set was obtained by combining the water-discoloring wall adhering material obtained above and a pressure-sensitive adhesive comprising a mixture of a polybutylene rubber and an inorganic mineral, as a wall fixture.

The pressure-sensitive adhesive was adhered to each corner on the back of the water-discoloring wall adhering material to fix the same to a wall.

When water was adhered to the porous layer of the water-discoloring wall adhering material, the porous layer became transparent to show the color change of from white to pink. The pink color state was maintained during water adhesion, but when water was evaporated by drying, the color returned to the original white color.

A water-discoloring wall adhering material set was obtained by combining the water-discoloring wall adhering material obtained above, a pressure-sensitive adhesive comprising a mixture of a polybutylene rubber and an inorganic mineral, as a wall fixture, and a writing material having a fiber-processed material having continuous pores as a pen tip member fitted to the tip of a water-storing container, as a tool for water adhesion.

The pressure-sensitive adhesive was adhered to each corner on the back of the water-discoloring wall adhering material to fix the same to a wall.

When water was applied to the porous layer of the water-discoloring wall adhering material using the writing material, clear pink handwriting was perceived.

The handwriting was maintained during the state of water adhesion. When water was lost by drying, the red color returned to the original white color, and the handwriting was in an invisible state. This aspect could be conducted repeatedly.

Water which forms the handwriting did not drop down even in a vertical state of the wall adhering material. Water was moderately absorbed in the woven fabric, and additionally, water did not strike through into the back of the non-woven fabric.

The water-discoloring wall adhering material did not fall down by its own weight in the state of adhering to the wall, and did not fall down during use.

Even when written repeatedly, concavity and convexity were not generated on the surface and breakage did not occur. Thus, the wall adhering material was excellent in durability.

While the invention has been described in detail and with reference to specific embodiments thereof, it will be apparent to one skilled in the art that various changes and modifications can be made therein without departing from the scope thereof.

This application is based on Japanese patent application No. 2006-191122 filed on Jul. 12, 2006, the entire contents thereof being hereby incorporated by reference.

What is claimed is:

1. A water-discoloring wall adhering material comprising:

a non-woven fabric comprising a cellulose fiber and a polyester fiber, and having a weight of from 40 to 150 $g/m^2$ and provided on a surface thereof a porous layer in an amount of from 5 to 50 $g/m^2$, the porous layer comprising a binder resin and a pigment having a refractive index in a range of from 1.4 to 1.8 dispersed in the binder resin, wherein the mixing ratio of the cellulose fiber to the polyester fiber is from 95:5 to 50:50, wherein the water-discoloring wall adhering material has a lightness value at a part on which the porous layer is formed being in a range of from 9.5 to 7.0 in a dry state, and a color tone of the non-woven fabric being partially perceived in a dry state, and wherein the water-discoloring wall adhering material has a gross weight of from 50 to 200 g/m$^2$, and has a stockigt sizing degree measured from the side at which the porous layer is provided of from 5 to 3,600 seconds.

2. A water-discoloring wall adhering material comprising:

a non-woven fabric comprising a cellulose fiber and a polyester fiber, and having a weight of from 40 to 150 g/m$^2$, wherein the mixing ratio of the cellulose fiber to the polyester fiber is from 95:5 to 50:50;

a colored layer provided on a surface of the non-woven fabric; and a porous layer provided on a surface of the colored layer in an amount of from 5 to 50 g/m$^2$, the porous layer comprising a binder resin and a pigment having a refractive index in a range of from 1.4 to 1.8 dispersed in the binder resin, wherein the water-discoloring wall adhering material has a lightness value at a part on which the porous layer is formed being in a range of from 9.5 to 7.0 in a dry state, and a color tone of the colored layer being partially perceived in a dry state, and wherein the water-discoloring wall adhering material has a gross weight of from 50 to 200 g/m$^2$, and has a stockigt sizing degree measured from the side at which the porous layer is provided of from 5 to 3,600 seconds.

3. The water-discoloring wall adhering material according claim 1, having tear strength of 100 g or more and wet tensile strength of 0.5 Kg/15 mm or more.

4. The water-discoloring wall adhering material according to claim 1, having a shape of a rectangle or a square, and comprising a belt colored pattern layer provided on an uppermost layer at the edge of at least one side.

5. The water-discoloring wall adhering material according to claim 4, wherein the colored pattern layer is a layer formed by a process printing comprising at least yellow, cyan and magenta.

6. A water-discoloring wall adhering material set comprising the water-discoloring wall adhering material according to claim 1 and a wall fixture.

7. The water-discoloring wall adhering material set according to claim 6, wherein the wall fixture is a pressure-sensitive adhesive.

8. The water-discoloring wall adhering material set according to claim 7, wherein the pressure-sensitive adhesive is a polybutylene rubber or a mixture of the polybutylene rubber and an inorganic mineral.

9. A water-discoloring wall adhering material set comprising the water-discoloring wall adhering material according to claim 1 and a tool for water adhesion.

10. The water-discoloring wall adhering material set according to claim 9, wherein the tool for water adhesion is a writing material or an applicator, having a pen tip member comprising a plastic porous body having continuous pores or a fiber-processed material.

11. A water-discoloring wall adhering material set comprising the water-discoloring wall adhering material according to claim 1, a wall fixture and a tool for water adhesion.

* * * * *